US010359720B2

(12) United States Patent
Hashimoto

(10) Patent No.: US 10,359,720 B2
(45) Date of Patent: Jul. 23, 2019

(54) IMAGE HEATING DEVICE

(71) Applicant: CANON KABUSHIKI KAISHA, Tokyo (JP)

(72) Inventor: Yoshinori Hashimoto, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/874,735

(22) Filed: Jan. 18, 2018

(65) Prior Publication Data

US 2018/0210377 A1 Jul. 26, 2018

(30) Foreign Application Priority Data

Jan. 20, 2017 (JP) ..... 2017-008377

(51) Int. Cl.
*G03G 15/20* (2006.01)

(52) U.S. Cl.
CPC ..... *G03G 15/2017* (2013.01); *G03G 15/206* (2013.01); *G03G 15/2057* (2013.01); *G03G 2215/2035* (2013.01)

(58) Field of Classification Search
CPC ..... G03G 15/201; G03G 15/2057; G03G 15/206; G03G 15/2064; G03G 15/2053; G03G 2215/2035
See application file for complete search history.

(56) References Cited

U.S. PATENT DOCUMENTS 6,002,908 A * 12/1999 Hayashi ..... G03G 15/1605 198/840
9,235,181 B2 * 1/2016 Egi ..... G03G 15/205
2008/0292374 A1 * 11/2008 Hiraoka ..... G03G 15/206 399/328
2012/0148303 A1 * 6/2012 Yamaguchi ..... G03G 15/2053 399/122
2013/0189005 A1 * 7/2013 Saito ..... G03G 15/2053 399/323
2014/0212189 A1 * 7/2014 Kondo ..... G03G 15/2053 399/329

(Continued)

FOREIGN PATENT DOCUMENTS

JP 2001-147605 A 5/2001
JP 2006-201370 A 8/2006

(Continued)

*Primary Examiner* — Francis C Gray
(74) *Attorney, Agent, or Firm* — Canon U.S.A. Inc., IP Division

(57) ABSTRACT

An image heating device includes a restricting member that restricts a lateral shift of a film in a longitudinal direction in a manner in which an edge surface of the film comes into contact with the restricting member when the film laterally shifts, a roller that forms a nip portion, a frame that has a groove in which the restricting member and the roller are inserted, and a pressurizing spring that pressurizes the restricting member and the roller. The restricting member includes a grooved portion, and protrusions that restrict inclination of the restricting member are formed on the grooved portion. When a pressure is applied to the restricting member and the roller, some of the protrusions are in contact with the frame, the other protrusions are not in contact with the frame, and a height of the some of the protrusions is more than a height of the other protrusions.

20 Claims, 11 Drawing Sheets

(56) References Cited

U.S. PATENT DOCUMENTS

| | | | | |
|---|---|---|---|---|
| 2014/0376935 | A1* | 12/2014 | Egi | G03G 15/2053 399/33 |
| 2014/0376979 | A1* | 12/2014 | Egi | G03G 15/2053 399/329 |
| 2016/0327893 | A1* | 11/2016 | Kim | G03G 15/2053 |
| 2018/0113405 | A1* | 4/2018 | Yasui | G03G 15/2028 |

FOREIGN PATENT DOCUMENTS

| | | | |
|---|---|---|---|
| JP | 2006-293225 | A | 10/2006 |
| JP | 2015-105979 | A | 6/2015 |

* cited by examiner

IMAGE HEATING DEVICE

BACKGROUND OF THE INVENTION

Field of the Invention

The present invention relates to an image heating device that is preferably used as a fixing device installed in an image-forming apparatus such as a copying machine, a printer, a fax machine, or a multifunction apparatus having these functions.

Description of the Related Art

A known film-type fixing device that is installed in, for example, an electrophotographic image-forming apparatus includes a flexible sleeve (referred to below as a rotating body) that is a fixing film (fixing belt) that moves while being in contact with a heating member (heater). The fixing device has a high efficiency of heat transfer and has advantages of a short time to reach a temperature that enables fixation after energizing of the heating member (heater) is started and a short time until a first image is outputted. There is also an advantage of a small power consumption on standby for a print instruction. In recent years, the fixing device is installed in many image-forming apparatuses.

In the film-type fixing device, a fixing nip portion that interposes a recording material therein and conveys the recording material is formed between a film unit and a pressure roller. The film unit includes a tubular fixing film, a heater in contact with an inner surface of the fixing film, a heater holder that is disposed in an interior space of the fixing film and that holds the heater, and a restricting member that faces an edge surface of an end portion of the fixing film in the longitudinal direction and that restricts a lateral shift of the fixing film in the longitudinal direction. The heater and the heater holder are pressurized by a pressurizing spring toward the pressure roller with the restricting member interposed therebetween. Thus, the fixing nip portion is formed. The film unit (more accurately, the restricting member) and the pressure roller are mounted on a frame of the fixing device in a manner in which both of the end portions thereof are inserted in a groove formed in the frame.

There is a space between the restricting member and the frame, and accordingly, a load applied by the pressurizing spring causes the restricting member to slightly incline with respect to the frame. In the case where the edge surface of the fixing film comes into contact with the restricting member in a state where the restricting member inclines, the fixing film is likely to damage. Japanese Patent Laid-Open No. 2006-293225 discloses an invention to address such a problem. However, there is a need for a more effective structure to inhibit the fixing film from damaging.

SUMMARY OF THE INVENTION

The present invention provides an image heating device that inhibits the fixing film from damaging.

The present invention provides an image heating device for heating an image formed on a recording material while interposing and conveying the recording material at a nip portion. The image heating device includes a tubular film, a restricting member that faces an edge surface of the film at an end portion of the film in a longitudinal direction and that restricts a lateral shift of the film in the longitudinal direction in a manner in which the edge surface of the film comes into contact with the restricting member when the film laterally shifts in the longitudinal direction, a roller that is in contact with an outer surface of the film and that forms the nip portion between the roller and the film, a frame that holds the restricting member and the roller and that has a groove in which the restricting member and the roller are inserted, and a pressurizing spring that pressurizes the restricting member and the roller. The restricting member includes a grooved portion for inserting the restricting member in the frame, and a plurality of protrusions that restrict inclination of the restricting member are formed on the grooved portion. When a pressure under which the image is heated is applied to the restricting member and the roller by the pressurizing spring, some of the plurality of protrusions are in contact with the frame, the others of the plurality of protrusions are not in contact with the frame, and a height of the some of the plurality of protrusions is more than a height of the others of the plurality of protrusions.

Further features of the present invention will become apparent from the following description of exemplary embodiments with reference to the attached drawings.

DESCRIPTION OF THE EMBODIMENTS

First Embodiment

Image-Forming Apparatus

Figure 4:
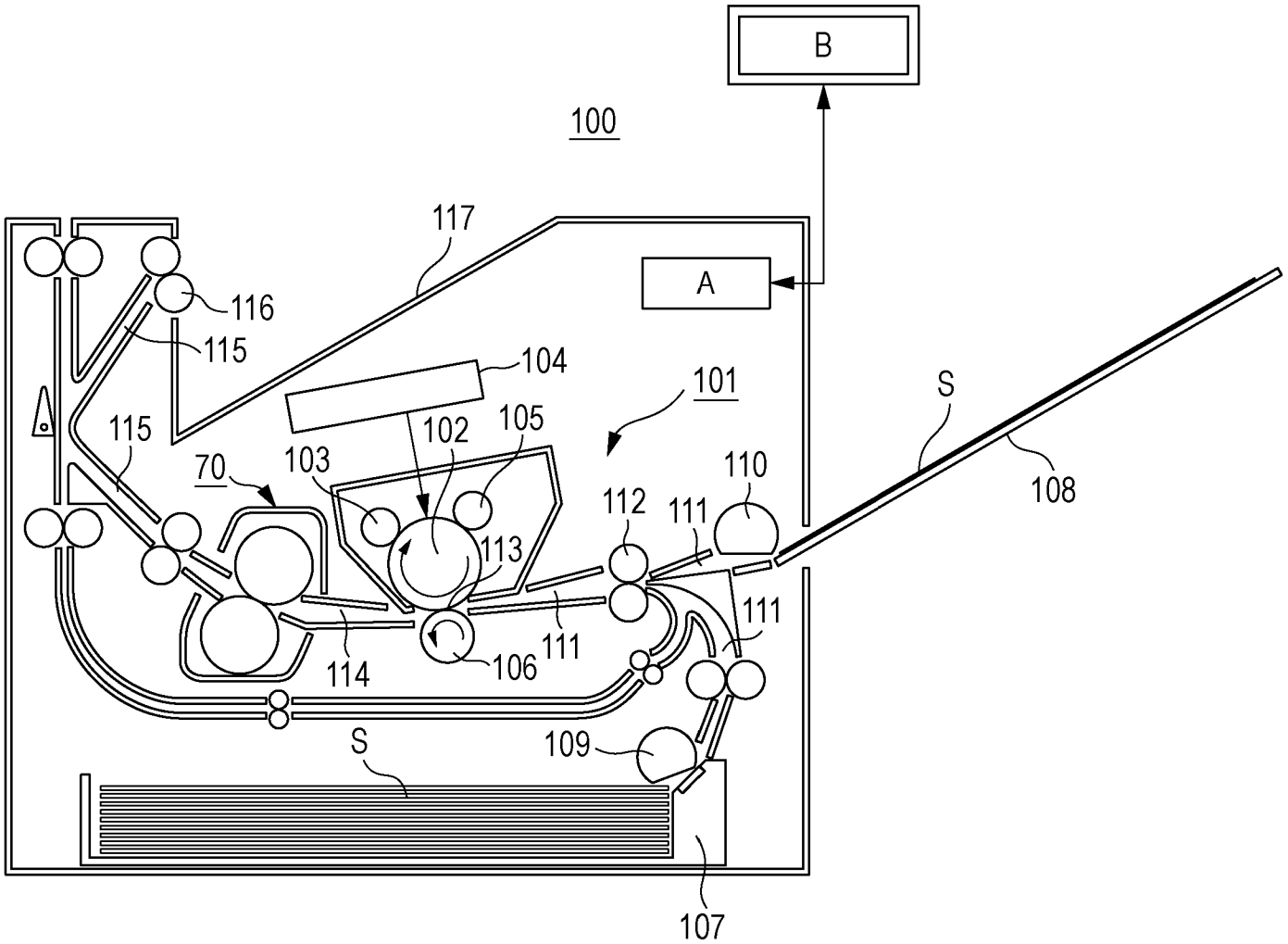
FIG. 4 is a schematic view of an example of an image-forming apparatus.

FIG. 4 schematically illustrates the structure of an example of an image-forming apparatus 100 including a fixing device (fixing unit) 70 serving as an image heating device according to an embodiment of the present invention. The image-forming apparatus 100 is a monochromatic printer that uses an electrophotographic process. When image information is inputted from an external device B such as a host computer to a control unit A, the control unit A performs a predetermined control sequence of image formation.

An image-forming unit 101 that forms a toner image on a recording material (referred to below as a sheet or paper) S includes a drum-shaped electrophotographic photosensitive member (referred to below as a drum) 102 that is rotated in a clockwise direction illustrated by an arrow. A charge roller 103, a laser scanner unit 104, a developing device 105, and a transfer roller 106 are disposed around the drum 102 in the direction in which the drum is rotated. The image formation operation (electrophotographic process) of the image-forming unit 101 is known and a detailed description thereof is omitted.

Sheets S stacked on a sheet feed cassette 107 or a sheet tray (manual feed tray) 108 are fed one by one by using rotation of a feed roller 109 or a feed roller 110. Each sheet S is introduced into a transfer nip portion 113 formed by the drum 102 and the transfer roller 106 through a conveyance path 111 on which a pair of resist rollers 112 is disposed with a predetermined control timing. The toner image on the drum 102 is transferred to the sheet S.

Each sheet S that has passed through the transfer nip portion 113 is conveyed to the fixing device 70 along a conveyance path 114 and is subjected to a hot pressing fixation of the toner image. The sheet S that exits the fixing device 70 passes through a conveyance path 115 and is discharged as an image-formed sheet to a discharge tray 117 by using a pair of discharge rollers 116.

Fixing Device

Regarding the fixing device 70 according to the embodiment, a front surface corresponds to an entrance side of the sheets S, and a back surface corresponds to an exit side of the sheets S. A left-hand side and a right-hand side correspond to the left-hand side (one end side) and the right-hand side (the other end side) when the fixing device 70 is viewed from the front. An upper side and a lower side correspond to the upper side and the lower side in the gravitational direction. An upstream side and a downstream side correspond to the upstream side and the downstream side in a sheet conveyance direction (recording-material conveyance direction). The generatrix direction of the fixing film, the axial direction of a pressure roller, or one of directions parallel thereto is referred to as a longitudinal direction. The direction perpendicular thereto is referred to as a transverse direction.

Figure 5:
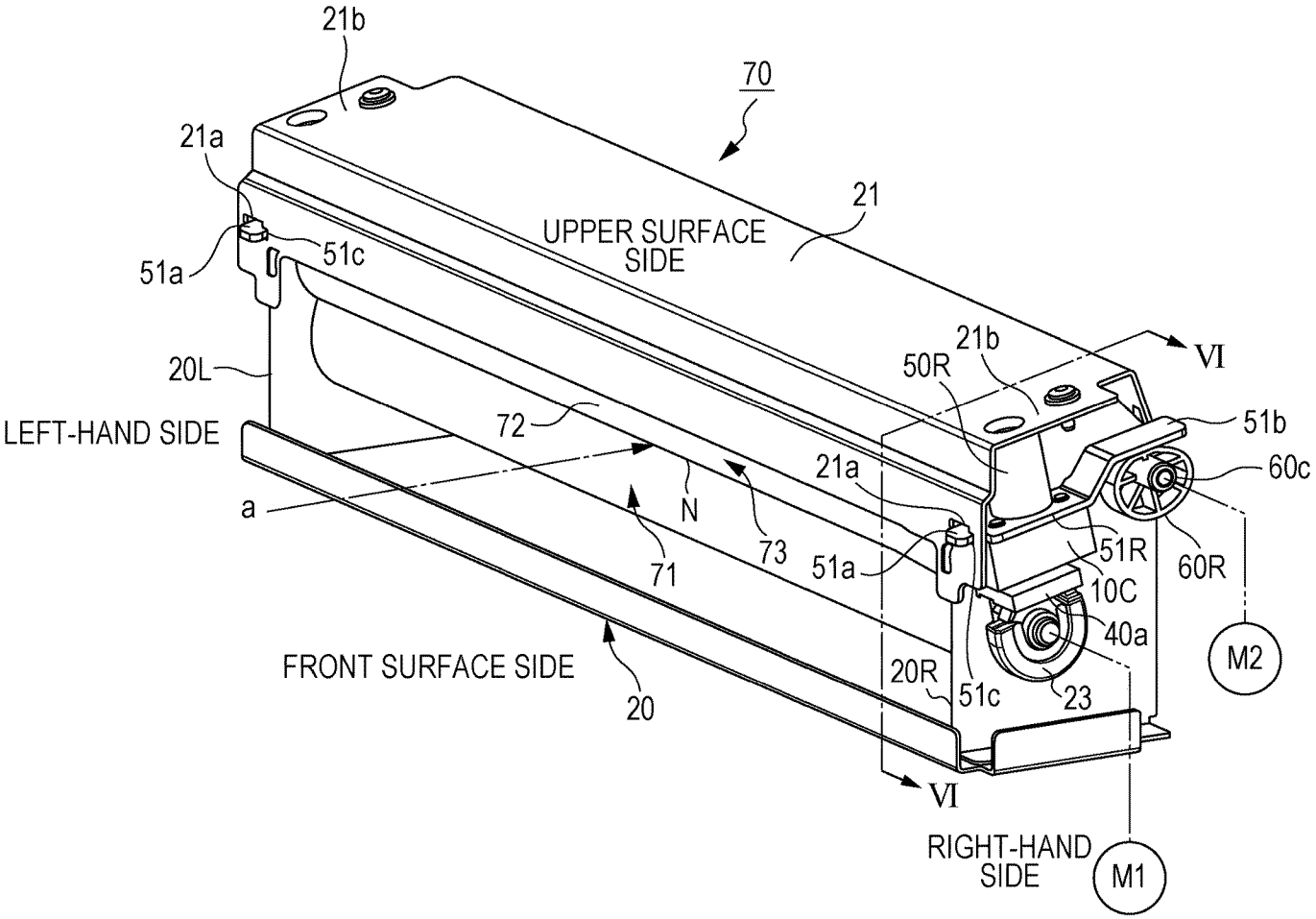
FIG. 5 is a perspective view of an example of a fixing device.
Figure 6:
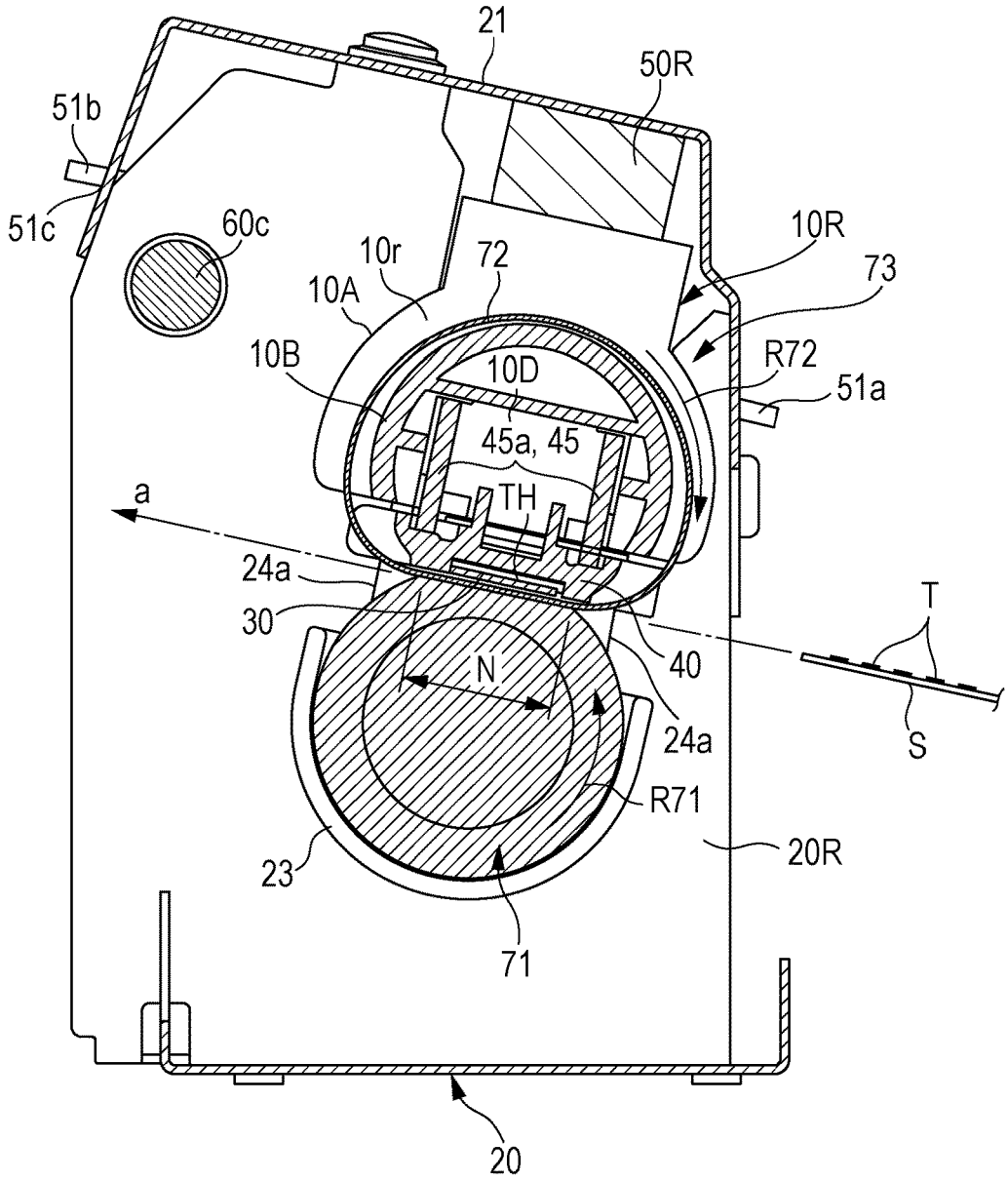
FIG. 6 is a schematic sectional view of FIG. 5 on the right-hand side taken along line VI-VI in FIG. 5.

The fixing device 70 is an image heating device of a film (belt) heated type that enables a start-up time and a power consumption to be decreased. FIG. 5 is a perspective view of the fixing device 70. FIG. 6 is a sectional view of FIG. 5 taken along line VI-VI.

Figure 7A:
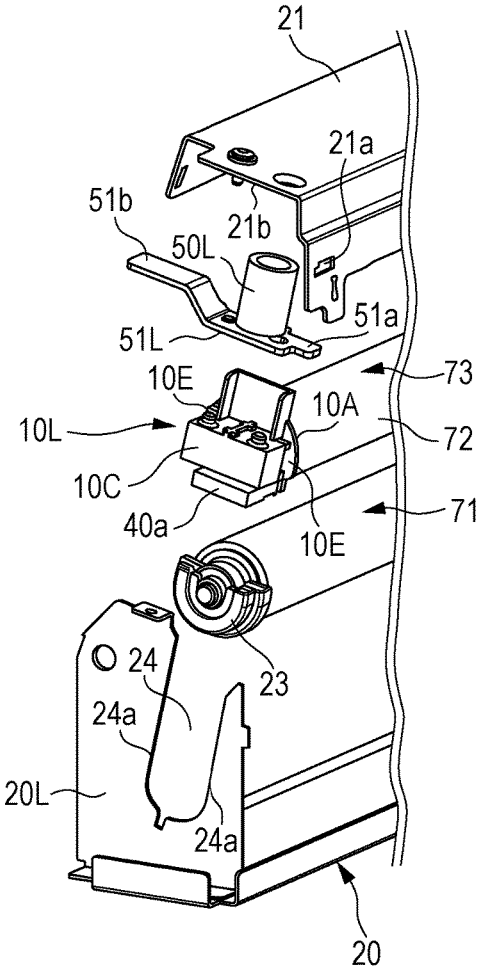
FIG. 7A is an exploded perspective view of the fixing device on one end side (left-hand side) of the fixing device.
Figure 7B:
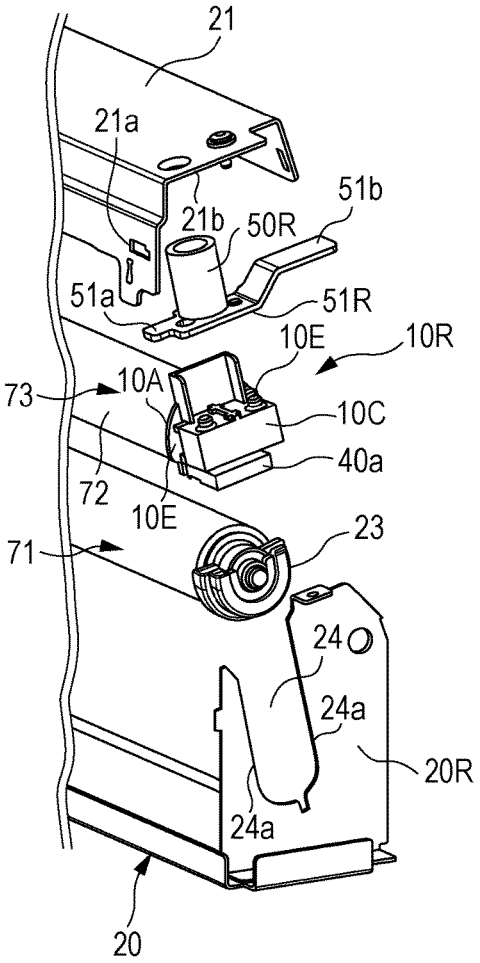
FIG. 7B is an exploded perspective view of the fixing device on the other end side (right-hand side).

The fixing device 70 mainly includes a film unit (belt unit) 73, an elastic pressure roller 71 serving as a facing body (pressurizing member), and a frame (housing or the main body of the apparatus) 20 that accommodates these components. FIG. 7A is an exploded perspective view of the fixing device 70 on one end side (left-hand side) of the fixing device. FIG. 7B is an exploded perspective view of the fixing device on the other end side (right-hand side).

(1) Film Unit (Belt Unit) 73

Figure 8:
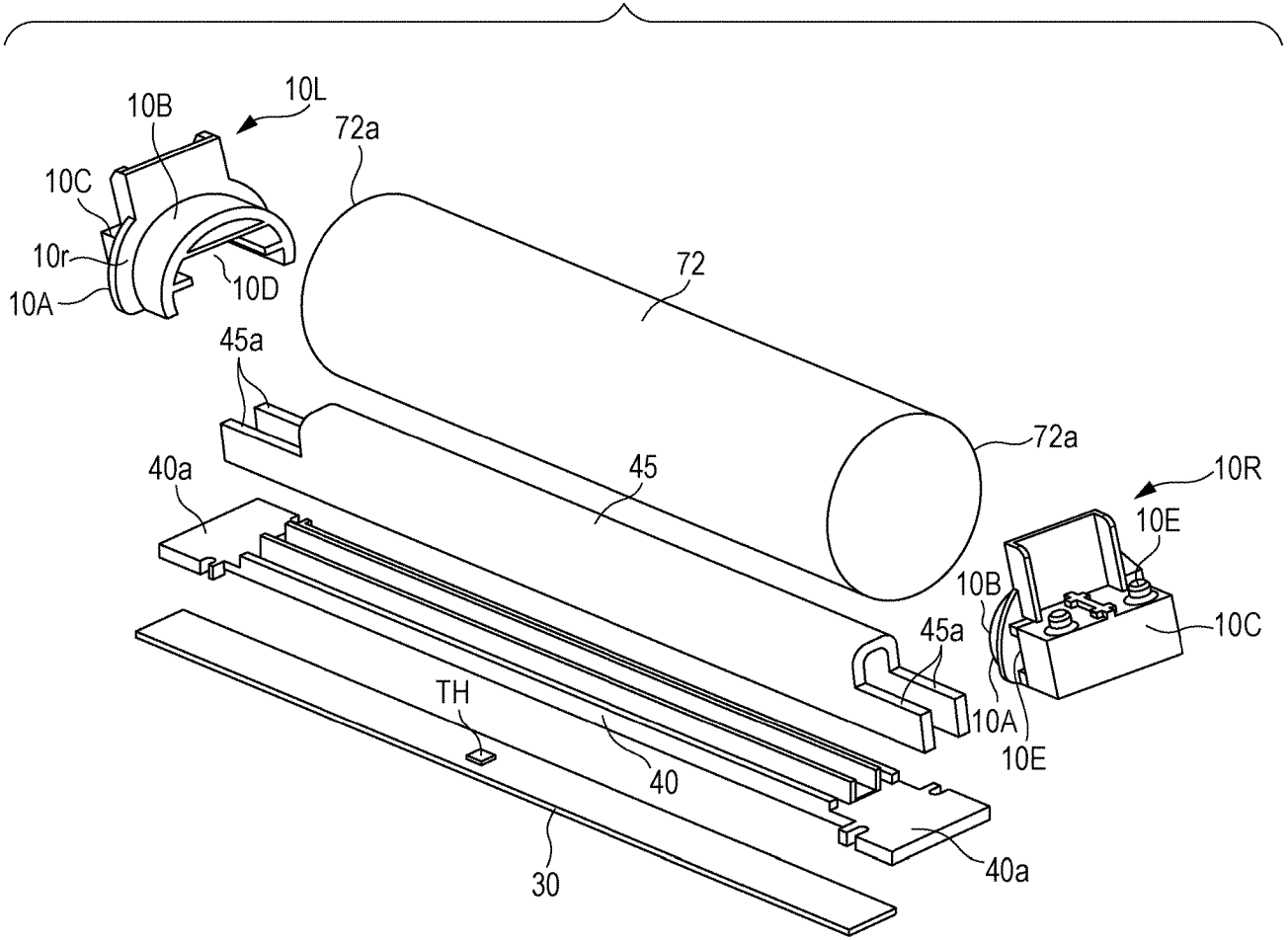
FIG. 8 is an exploded perspective view of a film unit.

The film unit 73 includes a fixing film (referred to below as a film) 72 that is a flexible tubular first rotating body. A heater (heating member) 30, a heater holder (heating-member holder, which is referred to below as a holder) 40 that holds the heater and that guides rotation of the film, and a stay 45 that holds the holder 40 are disposed inside the film 72 as an inner assembly. FIG. 8 is an exploded view of the film unit 73.

The heater 30, the holder 40, and the stay 45 each have a length larger than the width (length) of the film 72, and one end (left end) and the other end (right end) thereof protrude outward from both of the end portions of the film 72. Outward protruding portions of the holder 40 are denoted by 40*a*. Outward protruding portions of the stay 45 are denoted by 45*a*. Fixing flanges (rotating-body restricting members, which are referred to below as flanges) 10L and 10R on one end side and the other end side are installed on the respective outward protruding portions 45*a* of the stay 45 on one end side and the other end side. That is, the flanges 10L and 10R face both of the end portions of the film 72 in the longitudinal direction.

The flexible film 72 is a heat conductive member that has heat resistance and has a cylindrical shape in a free state due to its flexibility. For example, the flexible film is formed of a composite layer including three layers of a base layer of a heat-resistant resin material or a thin metal, an elastic layer of, for example, silicone rubber, and a surface layer of, for example, a fluorine resin in the order from the inside to the outside.

The heater 30 is a ceramic heater. The heater 30 includes a heat-resistant heater substrate (ceramic substrate) formed of, for example, aluminum nitride or alumina. A resistance pattern serving as a heat generating resistor (resistive heating element) that generates heat when being energized is formed on a front surface of the heater substrate in the longitudinal direction of the heater substrate by, for example, printing. A surface of the resistance pattern is coated with a glass layer serving as a protective layer. The inner surface of the film 72 is in close contact with a surface of the heater and slides thereon. A thermistor TH serving as a temperature-detecting member that detects the temperature of the heater 30 is disposed on the back surface side of the heater substrate.

The holder 40 is formed of a heat-resistant resin, supports the heater 30, and doubles as a rotation guide for the film 72. A grooved portion is formed on the lower surface of the holder 40 in the longitudinal direction. The heater 30 is supported with the heater fitted in the grooved portion such that the front surface faces outward. The material of the holder 40 is a heat-resistant resin such as a liquid-crystal polymer, a phenol resin, PPS, or PEEK. The stay 45 is a rigid member of a metal such as iron and pressurizes the entire length of the holder 40.

Each of the flanges 10 (L and R) disposed at both of the end portions of the film 72 in the longitudinal direction is a molded body that is molded with a heat-resistant resin and that has a bilaterally symmetric shape. The flanges 10 are each formed of a resin containing glass fibers such as PPS, a liquid-crystal polymer, PET, or PA, which has excellent heat resistance, relatively poor thermal conductivity, and excellent slippage properties. In the following description, the "flange 10L" is the left-hand-side (one-end-side) flange, the "flange 10R" is the right-hand-side (other-end-side) flange, and the "flanges 10" or the "flanges 10 (L and R)" are the left-hand-side and right-hand-side flanges.

Figure 9A:
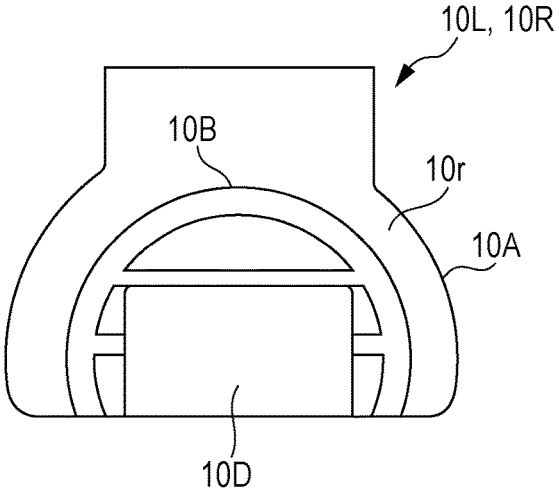
FIGS. 9A to 9D illustrate the structure of a flange.
Figure 9B:
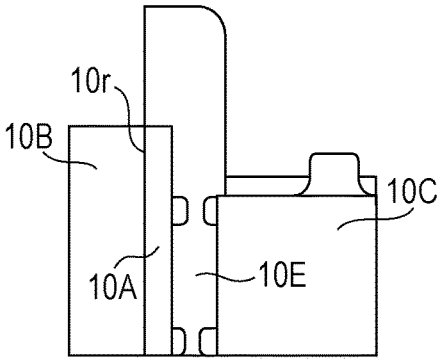
Figure 9C:
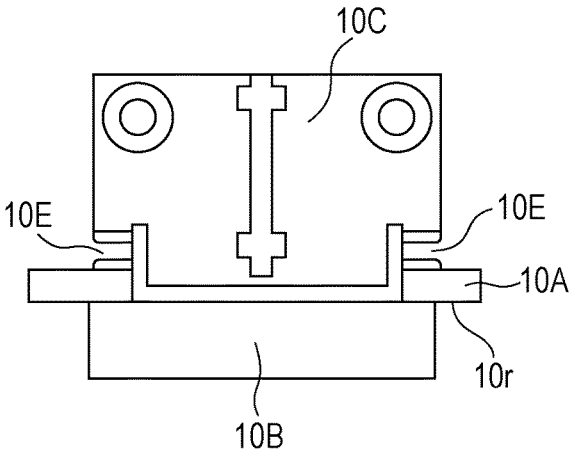
Figure 9D:
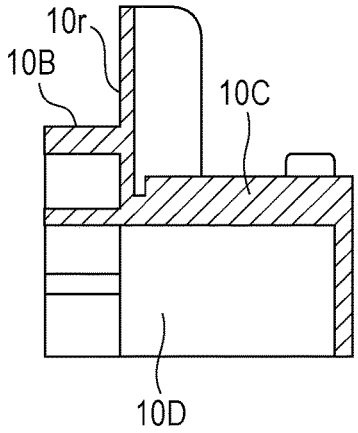

FIGS. 9A, 9B, and 9C illustrate one of the flanges 10 viewed from the inner-surface side, the side-surface side, and the upper-surface side, respectively. FIG. 9D illustrates a vertical section of FIG. 9B. Each of the flanges 10 includes a flange portion 10A having a rotating-body-restricting surface 10*r*, a rotating-body-guiding portion 10B, a pressure-receiving portion 10C, an installation portion 10D, and a grooved portion 10E.

Each rotating-body-guiding portion 10B is disposed on the rotating-body-restricting surface 10*r* of the corresponding flange portion 10A. Each pressure-receiving portion 10C is disposed on the side opposite the rotating-body-restricting surface 10*r* of the corresponding flange portion 10A. Each installation portion 10D extends to the corresponding rotating-body-guiding portion 10B, the corresponding flange portion 10A, and the corresponding pressure-receiving portion 10C. Each grooved portion 10E is disposed at a position at which the corresponding flange portion 10A and the corresponding pressure-receiving portion 10C face each other.

Each rotating-body-restricting surface 10*r* faces an edge surface 72*a* of a corresponding one of longitudinal end portions of the film 72 and serves a function of restricting movement of the film 72 in the longitudinal direction to cause the film 72 to stay at a predetermined position in the longitudinal direction. That is, the rotating-body-restricting surface 10*r* restricts movement of the film 72 in the longitudinal direction in a manner in which the rotating-body-restricting surface 10*r* comes into contact with the edge surface 72*a* of the longitudinal end portion of the film 72.

Each rotating-body-guiding portion 10B supports the inner circumferential surface of a corresponding one of the longitudinal end portions of the film 72 from the inside and guides rotation of the film 72. That is, the rotating-body-guiding portion 10B serves a function of restricting the longitudinal end portion of the film 72 from the inside to cause the film 72 to be rotated in a desirable manner.

Each installation portion 10D is installed on a corresponding one of the outward protruding portions 45*a* of the stay 45. Each pressure-receiving portion 10C is in direct contact with a corresponding one of the outward protruding portions 45*a* with the pressure-receiving portion 10C installed on the outward protruding portion 45*a* of the stay 45, and serves a function of pushing down the stay 45 by using a pressurizing mechanism described later.

Each grooved portion 10E is an engagement portion for side plates 20L and 20R of the frame 20. The flanges 10L and 10R are mounted on the frame 20 in a manner in which each grooved portion 10E is inserted and slid so as to follow a corresponding one of rims 24*a* having "U-shaped slits 24 formed in the side plates 20L and 20R, that is, the frame 20". This will be described later.

(2) Pressure Roller 71

The pressure roller 71 serving as a second rotating body (facing body) forms a nip portion N between the pressure roller 71 and the heater 30 with the film 72 interposed therebetween and is a drive rotating body that causes the film 72 to rotate. The pressure roller 71 is an elastic roller including an elastic layer on the outer circumferential side of a metal core such as a SUS, SUM, or Al core, and the elastic layer is formed of, for example, heat-resistant rubber such as silicone rubber or fluorine rubber, or foam rubber formed by foaming silicone rubber. A mold release layer such as a PFA, PTFE, or FEP layer may be formed on the elastic layer.

The pressure roller 71 is rotatably supported by the frame 20 in a manner in which axis portions on one end side and the other end side are held by the side plates 20L and 20R of the frame 20 on one end side and the other end side with bearing members 23 interposed therebetween. A driving force of a drive source M1 controlled by the control unit A is transmitted to the pressure roller 71 via a drive transmission mechanism (not illustrated), and the pressure roller 71 is thereby rotated at a predetermined circumferential velocity in the direction of an arrow R71 in FIG. 6.

The film unit 73 is disposed between the side plates 20L and 20R so as to be substantially parallel to the pressure roller 71. Each grooved portion 10E formed in the flanges 10L and 10R of the film unit 73 engages the rim 24*a* of a corresponding one of the slits 24 formed in the side plates 20L and 20R. In the engagement state, the flange portion 10A of the flange 10L is located inside the side plate 20L of the frame 20. The pressure-receiving portion 10C of the flange 10L is located outside the side plate 20L of the frame 20. The flange portion 10A of the flange 10R is located inside the side plate 20R of the frame 20. The pressure-receiving portion 10C of the flange 10R is located outside the side plate 20R of the frame 20.

The flanges 10L and 10R are held slidably in the vertical direction with respect to the side plates 20L and 20R. That is, the film unit 73 has degrees of freedom such that the film unit 73 can approach or leave from the pressure roller 71 along the rims 24*a* of the slits 24 between the side plates 20L and 20R.

(3) Pressurizing Mechanism

The pressure-receiving portions 10C of the flanges 10L and 10R are pressed by pressurizing mechanisms each including pressurizing springs (elastic members) 50L and 50R and pressurizing levers (pressurizing metal sheets) 51L and 51R, and are subjected to a predetermined pressure. The pressurizing levers 51L and 51R are disposed above the pressure-receiving portions 10C outside the side plates 20L and 20R. Each end portion 51*a* of the pressurizing levers 51L and 51R is inserted and fitted in a corresponding one of holes 21*a* of a top plate 21 of the frame 20. Each engagement portion thereof is denoted by 51*c*. The pressurizing levers 51L and 51R can swing on the engagement portions 51*c* in the vertical direction.

The pressurizing springs 50L and 50R are compressed between the pressurizing levers 51L and 51R and spring-receiving portions 21*b* of the top plate 21 on one end side and the other end side. According to the present embodiment, the pressurizing springs 50L and 50R are compression springs each having a coil shape. Tension springs or another pressurizing mechanism may be used in accordance with the structure of the apparatus.

Figure 10A:
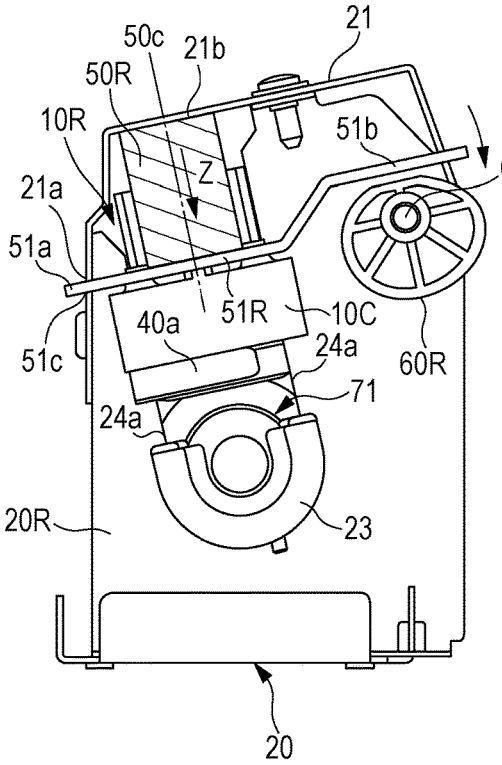
FIG. 10A illustrates the fixing device on the right-hand side in a pressurization condition.

The pressure-receiving portions 10C of the flanges 10L and 10R are pressed by the reaction force of the pressurizing springs 50L and 50R with the pressurizing levers 51L and 51R interposed therebetween. FIG. 10A illustrates the fixing device 70 on the right-hand side in this pressurization condition. The left-hand side of the fixing device 70 is symmetric with the right-hand side thereof. The direction of pressurization is denoted by Z. The center line 50*c* of the pressurizing spring 50R (50L) is located outside the side plate 20R (20L).

Since the flanges 10L and 10R are installed on the outward protruding portions 45*a* of the stay 45 on one end side and the other end side, the stay 45 is also subjected to the reaction force of the pressurizing springs 50L and 50R with the flanges 10L and 10R interposed therebetween in the pressurized state in FIG. 10A.

Thus, the holder 40 including the heater 30 and the pressure roller 71 are in pressure contact with each other with the film 72 interposed therebetween. In the fixing device 70 according to the present embodiment, the heater 30 and a part of the holder 40 function as sliding members (backup members) in contact with the inner surface of the film 72. As illustrated in FIG. 6, the nip portion N having a predetermined width in the sheet conveyance direction (recording-material conveyance direction) a is thus formed between the film 72 and the pressure roller 71.

The pressurizing levers 51L and 51R extend toward the opposite side of the engagement portion 51*c* from the boundaries of the pressure-receiving portions 10C of the flanges 10L and 10R. An extending lever portion thereof is denoted by 51*b*. Pressure release cams 60L and 60R serving as pressure release mechanisms that release the pressurization of the flanges 10L and 10R by the pressurizing springs 50L and 50R are disposed below the extending lever portions 51*b* of the pressurizing levers 51L and 51R outside the side plates 20L and 20R, respectively. The pressure release cam 60L is not illustrated. The pressure release cams 60L and 60R are eccentric cams that have the same shape and that are fastened to one end portion and the other end portion of a rotational shaft 60*c* rotatably supported between the side plates 20L and 20R in the same phase.

The driving force of a drive source M2 controlled by the control unit A is transmitted to the pressure release cams 60L and 60R via drive transmission mechanisms (not illustrated). As illustrated in FIG. 10A, when the pressure release cams 60L and 60R are controlled so as to have a posture at a rotational angle at which small-diameter portions thereof are located on the upper side, the pressure release cams 60L and 60R are not in contact with the extending lever portions 51*b* of the pressurizing levers 51L and 51R. For this reason, the pressurizing levers 51L and 51R are in a free state, and the fixing device 70 is in a pressurized state in which the nip portion N having a predetermined width is formed between the film 72 and the pressure roller 71.

Figure 10B:
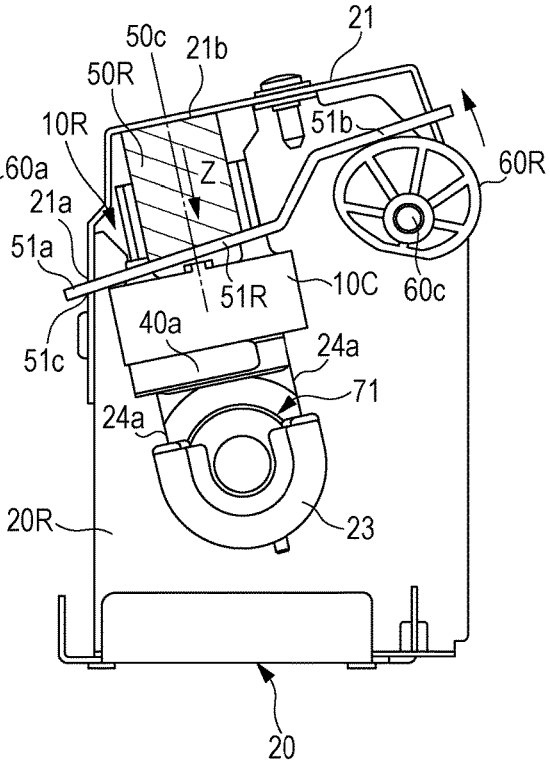
FIG. 10B illustrates the fixing device on the right-hand side in a non-pressurization condition.

As illustrated in FIG. 10B, when the pressure release cams 60L and 60R are controlled so as to have a posture at a rotational angle at which large-diameter portions thereof are located on the upper side, the pressure release cams 60L and 60R are in contact with the extending lever portions 51*b* of the pressurizing levers 51L and 51R. The pressure release cams 60L and 60R lift the pressurizing levers 51L and 51R against the reaction force of the pressurizing springs 50L and 50R about the engagement portions 51*c* between the end portions 51*a* and the holes 21*a*. This releases the pressurization of the pressure-receiving portions 10C of the flanges 10L and 10R by the pressurizing levers 51L and 51R. That is, the nip portion N formed is released, or the pressure applied to the nip portion N is decreased.

The fixing device 70 can thus switch the pressurized state (see FIG. 10A) and the non-pressurized state (see FIG. 10B). The non-pressurized state while no images are formed enables the elastic layer of the pressure roller 71 to be prevented from elastically deforming. When a paper jam occurs during paper feed, the pressurized state is switched to the non-pressurized state, and the sheet can be easily removed from the nip portion N.

(4) Fixing Operation

The control unit A causes the image-forming apparatus 100 to start image formation in response to an image formation start signal. When the image formation start signal is inputted, the fixing device 70 switches the non-pressurized state (see FIG. 10B) to the pressurized state (see FIG. 10A), and the pressure roller 71 is rotated. The rotation of the pressure roller 71 creates a frictional force between the nip portion N and the pressure roller 71, and the frictional force causes a rotational force to act on the film 72. Consequently, the inner surface of the film 72 comes into sliding contact with a surface of the heater 30 and a part of the outer surface of the holder 40 at the nip portion N and the film 72 rotates in the direction of an arrow R72 (see FIG. 6).

The heater 30 is supplied with power from a power supply member (not illustrated) via a power supply path (not illustrated) and rapidly generates heat. The temperature of the heater 30 is detected by the thermistor TH in contact with the back surface of the heater. Information about the detected temperature is inputted to the control unit A. The control unit A appropriately controls the power to be supplied to the heater 30 from the power supply member in accordance with the inputted information about the detected temperature to increase the temperature of the heater 30 to a predetermined temperature and to maintain the temperature.

Thus, the pressure roller 71 is rotated, and the film 72 is rotated due to the rotation. In a state where the temperature of the heater 30 is increased to a predetermined temperature and this temperature is maintained, the sheet S on which an unfixed toner image T is formed is introduced into the nip portion N from the image-forming unit 101. The sheet S is introduced into the nip portion N, interposed therein, and conveyed such that the surface on which the toner image T is formed faces the film 72. Thus, the unfixed toner image T on the sheet is heated, pressed, and fixed as a fixed image. The sheet S that has passed through the nip portion N is separated from the curved surface of the film 72, discharged from the fixing device 70, and conveyed.

(5) Mounting of Flange on Side Plate

The flanges 10L and 10R of the film unit 73 are mounted on the side plates 20L and 20R so as to be movable in the direction of the pressurization, as described above. During the pressurization (pressing) by the pressurizing mechanisms 50 and 51, the flanges 10L and 10R pressurize the stay 45 while moving toward the pressure roller 71. That is, the nip portion N is pressurized with a predetermined pressure. When the pressurization is released by the pressure release mechanisms 60, the flanges 10L and 10R move in the direction opposite the direction toward the pressure roller 71, and the pressure at the nip portion N decreases.

For this reason, appropriate spaces are formed between the flanges 10L and 10R and engagement portions of the side plates 20L and 20R so that the flanges 10L and 10R can smoothly move with respect to the side plates 20L and 20R. That is, appropriate spaces are formed between the grooved portions 10E of the flanges 10L and 10R and the engagement portions of the rims 24*a* of the slits 24. The flange 10R on the other end side will now be representatively described. The same is true for the flange 10L on one end side.

Figure 11A:
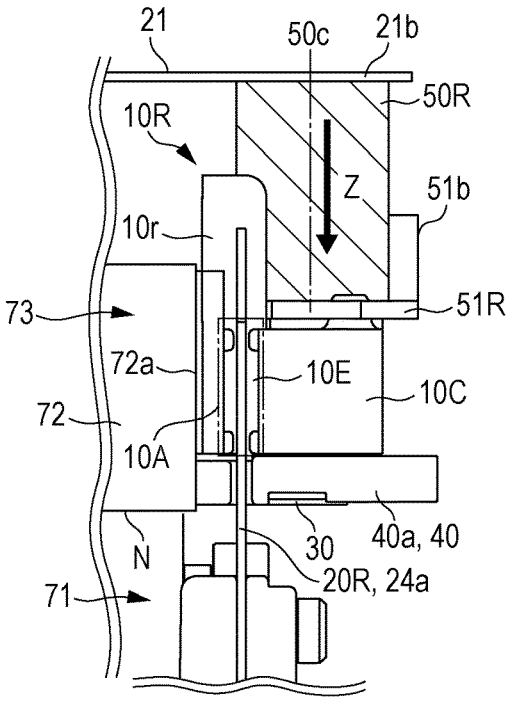
FIGS. 11A to 11C illustrate inclination of the flange.
Figure 11B:
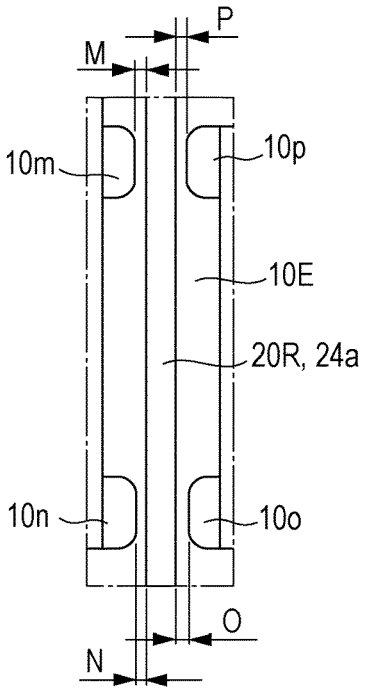
Figure 11C:
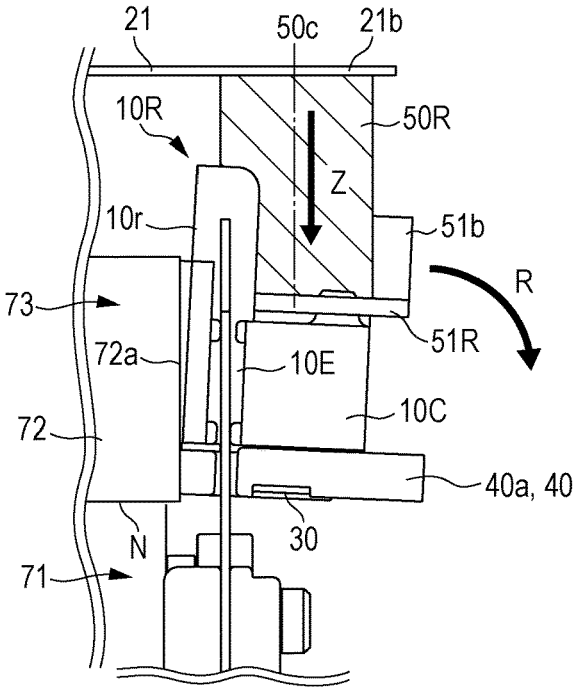

FIG. 11A to FIG. 11C illustrate a comparative example.

FIG. 11B is an enlarged view of a portion surrounded by a one-dot chain line in FIG. 11A. There are spaces M, N, O, and P between restricting surfaces (protrusions) 10*m*, 10*n*, 10*o*, and 10*p* that face the side plate 20R (24*a*) and that are formed on the grooved portion 10E of the flange 10R and the inner surface (inner surface of the frame) of the side plate 20R and between the restricting surfaces 10*m*, 10*n*, 10*o*, and 10*p* and the outer surface (outer surface of the frame) of the side plate 20R, where M=N and O=P hold.

The position of the film 72 in a roller axis direction (thrust direction) is restricted by the restricting surface 10*r* of the flange portion 10A of the flange 10R. That is, when the film 72 shifts in the roller axis direction, misalignment of the film 72 is prevented in a manner in which the edge surface 72*a* of the longitudinal end portion of the film 72 comes into contact with the restricting surface 10*r*.

However, in the case where the center line 50*c* of the pressurizing spring 50R is located outside the side plate 20R in the roller axis direction, as illustrated in FIG. 11C, the flange 10R inclines in the direction of R within the range of the spaces M, N, 0, and P during pressurization. Accordingly, the restricting surface 10*r* of the flange 10R also inclines, the edge surface 72*a* of the film 72 comes into local contact with the restricting surface 10*r*, and there is a risk of damage to the edge surface of the film (end portion of the film). FIG. 11C is an exaggerated view of the flange 10R that inclines in the direction of R.

In view of this, there is a need for a fixing device that inhibits the restricting surface 10*r* of each flange 10 from inclining with respect to the frame 20 and that prevents an excessive load from being applied to the edge surface 72*a* of the film 72. There is also a need for a structure for stably releasing pressure that does not inhibit smooth movement during pressurization and non-pressurization. The fixing device desirably fulfills these needs.

Figure 1A:
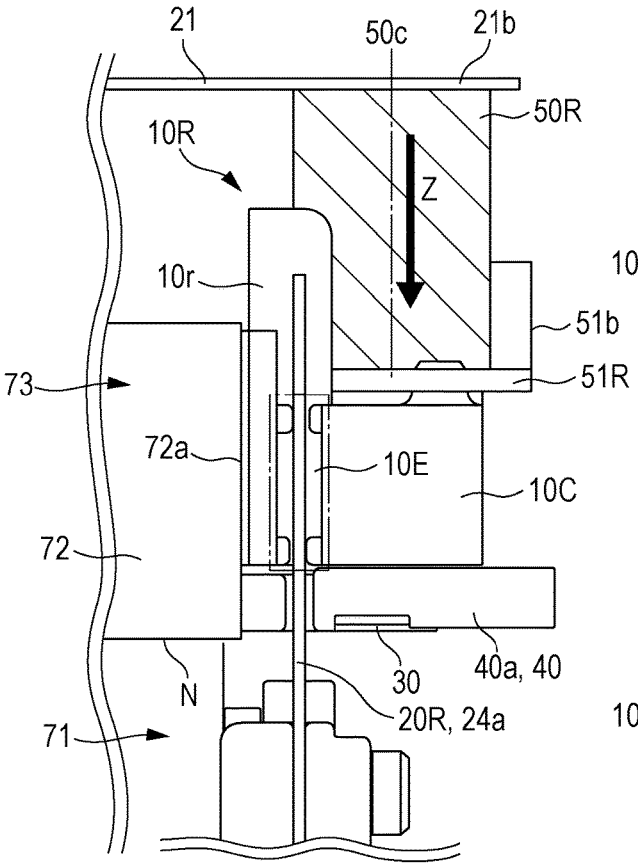
FIGS. 1A and 1B illustrate the structure of a main part of a fixing device according to a first embodiment.
Figure 1B:
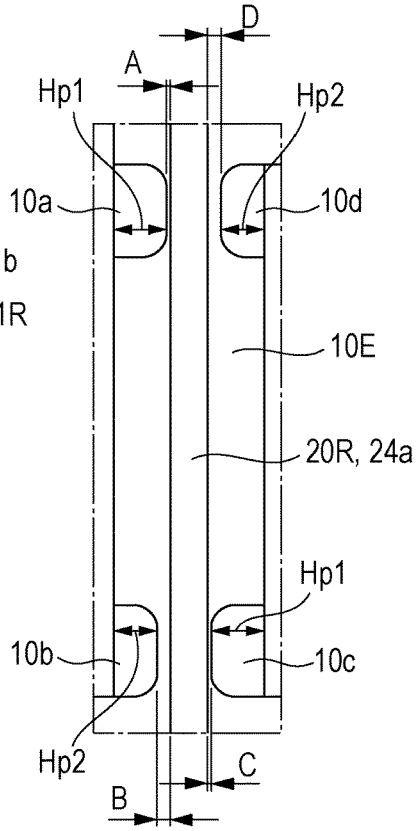

For this reason, the flanges 10 according to a first embodiment have an inclination-preventing structure as illustrated in FIGS. 1A and 1B. FIG. 1A is a schematic diagram in the roller axis direction (thrust direction) when the film 72 is pressed against the pressure roller 71. FIG. 1B is an enlarged view of a portion surrounded by a one-dot chain line in FIG. 1A and illustrates the flange 10R and the engagement portion of the side plate 20R.

Restricting surfaces (protrusions) of the flange 10R that face the side plate 20R in the roller axis direction are denoted by 10*a*, 10*b*, 10*c*, and 10*d*. The restricting surfaces 10*a* and 10*b* restrict the inside in the roller axis direction, that is, the inner surface of the side plate 20R. The restricting surfaces 10*c* and 10*d* restrict the outside in the roller axis direction, that is, the outer surface of the side plate 20R. Spaces between the restricting surfaces 10*a*, 10*b*, 10*c*, and 10*d* and the side plate 20R are denoted by A, B, C, and D.

In the fixing device 70 according to the first embodiment, the spaces between the restricting surfaces 10*a*, 10*b*, 10*c*, and 10*d* of the flange 10R and the engagement portion of the side plate 20R in the roller axis direction satisfy A<B and C<D. More specifically, the protruding amount of the restricting surface 10*a* is more than the protruding amount of the restricting surface 10*b*, and the protruding amount of the restricting surface 10*c* is more than the protruding amount of the restricting surface 10*d*. The protruding amount of the restricting surface 10*a* is equal to the protruding amount of the restricting surface 10*c*. The protruding amount of the restricting surface 10*b* is equal to the protruding amount of the restricting surface 10*d*.

With this structure of the restricting surfaces 10*a*, 10*b*, 10*c*, and 10*d*, dimensional tolerances are set and managed, for example, such that A=0.05 mm, B=0.10 mm, C=0.05 mm, and D=0.10 mm hold and each component is dimensioned to satisfy A<B and C<D. That is, when the flange 10R is pressurized by the pressurizing spring 50R and the pressurizing lever 51R in the Z-direction and inclines, the spaces A and C are smaller than the spaces B and D on the opposite side.

When a pressure under which an image is heated is applied to the flange 10R and the pressure roller 71 by the pressurizing spring 50R, the height Hp1 of the restricting surfaces (protrusions) 10*a* and 10*c* that are in contact with the frame (side plate 20R) is more than the height Hp2 of the other restricting surfaces 10*b* and 10*d* that are not in contact with the frame. In other words, during the pressurization by the pressurizing spring 50R, the height Hp1 of the restricting surfaces (protrusions) 10*a* and 10*c* that approach the frame (side plate 20R) is more than the height Hp2 of the other restricting surfaces 10*b* and 10*d* that leave from the frame.

To summarize, the relationship between the restricting surfaces and the spaces according to the first embodiment is as follows. There are the spaces A, B, C, and D between the restricting surfaces 10*a*, 10*b*, 10*c*, and 10*d*, which are formed on the flange 10R and interpose the side plate 20R therebetween, and the side plate 20R. During the pressurization by the pressurizing mechanism, the spaces A and C between the restricting surfaces 10*a* and 10*c* on the side on which the flange 10R inclines and approaches the side plate 20R and the side plate 20R are smaller than the spaces B and D between the restricting surfaces 10*b* and 10*d* on the side on which the flange 10R leaves from the side plate 20R and the side plate 20R.

Among the restricting surfaces 10*a*, 10*b*, 10*c*, and 10*d*, the restricting surfaces 10*a* and 10*c* on the side on which the flange 10R inclines and approaches the side plate 20R during the pressurization by the pressurizing mechanism are referred to as first restricting surfaces. The restricting surfaces 10*b* and 10*d* on the side on which the flange 10R leaves from the side plate 20R are referred to as second restricting surfaces. In this case, the protruding amount of the first restricting surfaces 10*a* and 10*c*, which is toward the flange 10R, is more than that of the second restricting surfaces 10*b* and 10*d*.

In this way, the inclination of the flange 10R pressurized by the pressurizing spring 50R with respect to the side plate 20R can be minimized. That is, the restricting surface 10*r* of the flange 10R can be inhibited from inclining. Accordingly, the restricting surface 10*r* and the film 72 can be prevented from coming into local contact with each other, and the end portion of the film 72 can be prevented from damaging.

In the case where A<D and C<B hold, and the surfaces are distinguished clearly between surfaces actively making contact and surfaces having spaces, movement of the flange 10R is not impeded when the fixing device 70 switches the pressurized state and the non-pressurized state. The same is true for the flange 10L and the side plate 20L.

Accordingly, the end portion of the film 72 can be prevented from damaging, and smooth movement can be achieved during pressurization and non-pressurization.

Second Embodiment

Figure 2A:
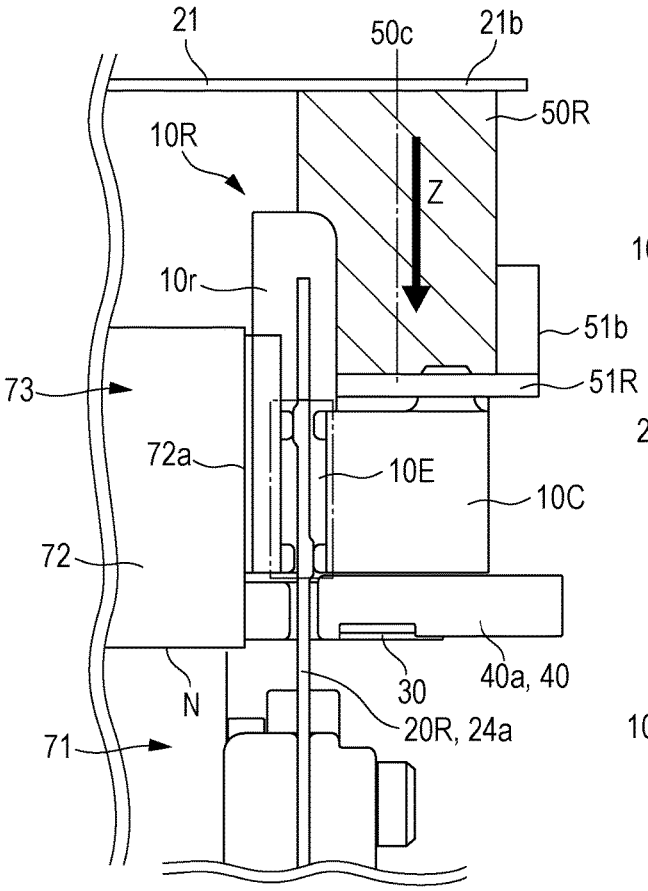
FIGS. 2A and 2B illustrate the structure of a main part of a fixing device according to a second embodiment.
Figure 2B:
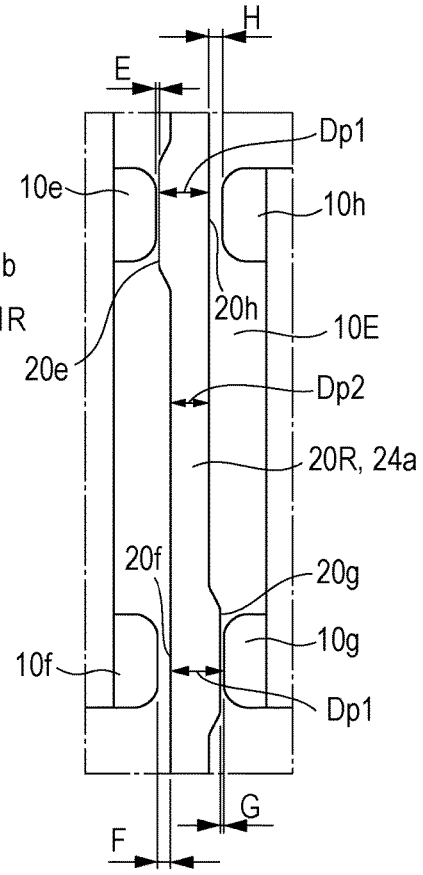

FIGS. 2A and 2B illustrate mounting of the flange on the side plate according to a second embodiment. FIG. 2A is schematic diagram in the roller axis direction (thrust direction) when the film 72 is pressed against the pressure roller 71. FIG. 2B is an enlarged view of a portion surrounded by a one-dot chain line in FIG. 2A and illustrates the flange 10R and the engagement portion of the side plate 20R. Basic structures in FIGS. 2A and 2B are the same as in FIGS. 1A and 1B according to the first embodiment, and a description thereof is omitted. The flange 10R on the other end side will now be representatively described. The same is true for the flange 10L on one end side.

The second embodiment differs from the first embodiment in that protrusions 20*e* and 20*g* are formed on the side plate 20R to reduce the space between the flange 10R and the engagement portion of the side plate 20R. That is, the protruding amounts of restricting surfaces (protrusions) 10*e* and 10*f* of the flange 10R are equal to each other, the protruding amounts of restricting surfaces 10*g* and 10*h* are equal to each other, and the restricting surfaces (protrusions) 20*e* and 20*g* of the side plate 20R face the restricting surfaces 10*e* and 10*g*. Thus, the spaces between the restricting surfaces (protrusions) 10*e*, 10*f*, 10*g*, and 10*h* of the flange 10R and the side plate 20R or the engagement portion of the restricting surfaces 20*e* and 20*g* in the roller axis direction satisfy E<F and G<H.

More specifically, dimensional tolerances are set and managed, for example, such that E=0.05 mm, F=0.10 mm, G=0.05 mm, H=0.10 mm hold, and each component is dimensioned to satisfy E<F and G<H. That is, when the flange 10R is pressurized by the pressurizing spring 50R and the pressurizing lever 51R in the Z-direction and inclines, the spaces E and G are smaller than the spaces F and H on the opposite side. According to the present embodiment, when a pressure under which an image is heated is applied to the flange 10R and the pressure roller 71 by the pressurizing spring 50R, the width Dpi of portions of the frame (side plate 20R) that are in contact with the restricting surfaces (protrusions) 10*e* and 10*g* is more than the width of the other portions of the frame. The portions of the frame (side plate 20R) that are in contact with the restricting surfaces (protrusions) 10*e* and 10*g* protrude toward the restricting surfaces 10*e* and 10*g* more than the other portions of the frame.

To summarize, the relationship between the restricting surfaces and the spaces according to the second embodiment is as follows. The side plate 20R of the frame has the restricting surfaces 20*e*, 20*f*, 20*g*, and 20*h* that face the restricting surfaces 10*e*, 10*f*, 10*g*, and 10*h* formed on the flange 10R.

When the flange 10R is pressurized by the pressurizing mechanism and inclines, among the restricting surfaces formed on the side plate 20R, the restricting surfaces 20*e* and 20*g* that the restricting surfaces 10*e* and 10*g* of the flange 10R approach are referred to as the first restricting surfaces. The restricting surfaces 20*f* and 20*h* from which the restricting surfaces 10*f* and 10*h* of the flange 10R leave are referred to as the second restricting surfaces. The protruding amount of the first restricting surfaces 20*e* and 20*g*, which is toward the flange 10R, is more than that of the second restricting surfaces 20*f* and 20*h*.

In this way, the inclination of the flange 10R pressurized by the pressurizing spring 50R with respect to the side plate 20R can be minimized. That is, the restricting surface 10*r* of the flange 10R can be inhibited from inclining. Accordingly, the restricting surface 10*r* and the film 72 can be prevented from coming into local contact with each other, and the end portion of the film 72 can be prevented from damaging.

In the case where E<H and G<F hold, and the surfaces are distinguished clearly between surfaces actively making contact and surfaces having spaces, movement of the flange 10R is not impeded when the pressurized state and the non-pressurized state are switched. The same is true for the flange 10L and the side plate 20L.

Accordingly, the end portion of the film 72 can be prevented from damaging, and smooth movement can be achieved during pressurization and non-pressurization.

Third Embodiment

Figure 3A:
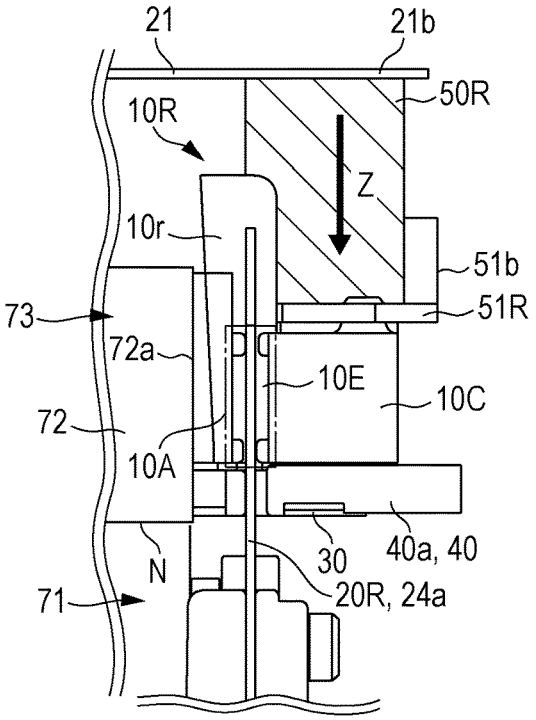
FIGS. 3A, 3B, and 3C illustrate the structure of a main part of a fixing device according to a third embodiment.
Figure 3B:
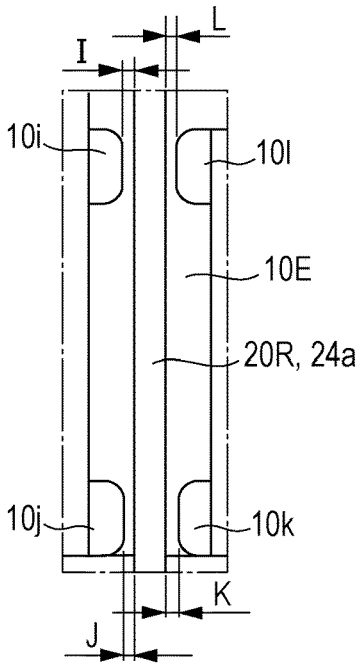
Figure 3C:
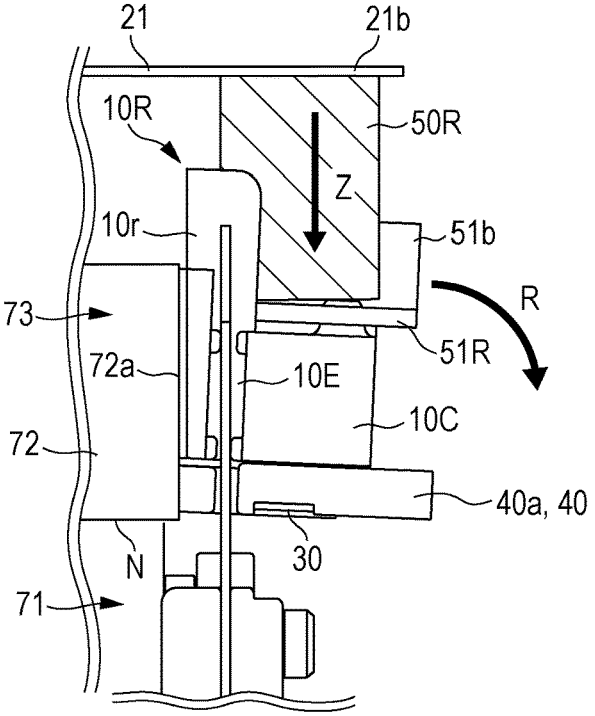

FIGS. 3A, 3B, and 3C illustrate mounting of the flange on the side plate according to a third embodiment. The flange 10R on the other end side will now be representatively described. The same is true for the flange 10L on one end side. Basic structures in FIGS. 3A, 3B, and 3C are the same as in FIGS. 9A to 9D, and FIGS. 1A and 1B and FIGS. 2A and 2B according to the first and second embodiments, and a description thereof is omitted.

FIG. 3A is a schematic diagram in the roller axis direction (thrust direction) before the film 72 is pressed against the pressure roller 71. FIG. 3B is an enlarged view of a portion surrounded by a one-dot chain line in FIG. 3A. FIG. 3C is a schematic diagram in the roller axis direction (thrust direction) when the film 72 is pressed against the pressure roller 71.

According to the third embodiment, when the flange 10R is pressurized by the pressurizing spring 50R and inclines in a space between the grooved portion 10E and the engagement portion of the rim 24*a* of the slit 24 of the side plate, the restricting surface 10*r* is substantially parallel to the side plate 20R.

That is, in the fixing device 70 of the third embodiment, the protruding amounts of restricting surfaces (protrusions) 10*i* and 10*j* at the grooved portion 10E of the flange 10R are equal to each other, and the protruding amounts of restricting surfaces 10*k* and 10*l* are equal to each other. Before the pressurization by the pressurizing spring 50R, spaces I, J, K, and L between the restricting surfaces (protrusions) 10*i*, 10*j*, 10*k*, and 10*l* and the side plate 20R satisfy I=J and K=L, and the spaces between the flange 10R and the side plate 20R are ensured. At this time, in the fixing device 70 according to the third embodiment, as illustrated in FIG. 3A, the restricting surface 10*r* of the flange 10R slightly inclines downward with respect to the side plate 20R.

When the flange 10R is pressurized by the pressurizing spring 50R, as illustrated in FIG. 3C, the flange 10R rotates in the direction of R within the range of the spaces I, J, K, and L between the restricting surfaces and the side plate 20R, and the restricting surfaces (protrusions) 10*i* and 10*k* incline until the restricting surfaces 10*i* and 10*k* come into contact with the side plate 20R. At this time, the restricting surface 10*r* is substantially parallel to the side plate 20R.

When a pressure under which an image is heated is applied to the flange 10R and the pressure roller 71 by the pressurizing spring 50R, the grooved portion 10E of the flange 10R inclines with respect to the side plate 20R (frame), and the restricting surface 10*r* of the flange 10R is substantially parallel to the side plate 20R.

To summarize, the above structure according to the third embodiment is as follows. The restricting surfaces 10*i*, 10*j*, 10*k*, and 10*l*, which are formed on the flange 10R and interpose the side plate 20R of the frame therebetween, incline during the pressurization by the pressurizing mechanism, and the restricting surfaces 10*i* and 10*k* come into contact with the side plate 20R. At this time, the rotating-body-restricting surface 10*r* of the flange 10R, which restricts movement of the film 72 in the longitudinal direction, is substantially parallel to the side plate 20R.

In this way, in the pressurized state by using the pressurizing spring 50R of the pressurizing mechanism, the restricting surface 10*r* can be inhibited from inclining. Accordingly, the restricting surface 10*r* and the film 72 can be prevented from coming into local contact with each other, and the end portion of the film 72 can be prevented from damaging.

In the case where the spaces I, J, K, and L between the restricting surfaces (protrusions) 10*i*, 10*j*, 10*k*, and 10*l* and the side plate 20R are ensured, movement of the flange 10R is not impeded when the pressurized state and the non-pressurized state are switched. The same is true for the flange 10L and the side plate 20L.

Accordingly, the end portion of the film 72 can be prevented from damaging, and smooth movement can be achieved during pressurization and non-pressurization.

According to the above three embodiments, the inclination of the restricting surfaces 10*r* of the flanges 10 pressurized by the pressurizing springs 50 with respect to the side plates of the frame 20 can be minimized, and the restricting surfaces 10*r* and the film 72 can be prevented from coming into local contact with each other. In the case where the restricting surfaces of the flanges 10 and the side plates of the frame 20 are distinguished clearly between surfaces actively making contact and surfaces having spaces, movement of the flanges 10 is not impeded when the pressurized state and the non-pressurized state are switched. Accordingly, each end portion of the film 72 can be prevented from damaging, and smooth movement can be achieved during pressurization and non-pressurization.

Other Matters (1) According to the above three embodiments, the number of the restricting surfaces (protrusions) at the grooved portion 10E of each flange 10 is two on each of the sides that interpose the respective side plates of the frame 20 therebetween. However, the number is not limited thereto. As described above, the number can be one on each side provided that the relationship of the spaces in consideration for the inclination of the flanges 10 holds, or three or more restricting surfaces may be formed.

(2) In the fixing device 70 according to the embodiments, the flanges 10L and 10R are disposed on one end side and the other end side of the film 72. However, in the case where the film 72 laterally shifts in one direction only, it is possible that the flange 10 alone is disposed on the side of the lateral shift of the film.

(3) According to the embodiments, the film-type fixing device described above is an example of the fixing device 70. However, the fixing device 70 is not limited thereto. Suitable examples include a fixing device that includes a halogen heater inside a fixing roller (heat roller) and that heats the fixing roller.

(4) The sliding members (backup members) inside the film 72 may be members other than the heater 30.

(5) A measure of heating the first rotating body film 72 is not limited to the heater 30 according to the embodiments. A halogen heater or another appropriate heater having an internal heating structure, an external heating structure, a contact heating structure, or a non-contact heating structure that uses another heating measure, such as an electromagnetic induction coil, can be used.

(6) The film 72 can be formed of a drive rotating body, and the pressure roller 71 can be rotated due to rotation of the film 72.

(7) The image heating device described by way of example according to the embodiments is the fixing device that heats and fixes the unfixed toner image formed on the recording material. However, the image heating device is not limited to thereto. The present invention can be used for an apparatus (gloss-improving apparatus) that reheats a fixed or temporarily fixed toner image on the recording material to increase the gloss of an image.

(8) The image-forming apparatus is not limited to the apparatus that forms a monochromatic image according to the embodiments. The image-forming apparatus may form a color image. The image-forming apparatus can include additional machinery, equipment, and housing structure necessary to have various applications such as a copying machine, FAX, and multifunction apparatus having these functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-008377 filed Jan. 20, 2017, which is hereby incorporated by reference herein in its entirety.

What is claimed is:

1. An image heating device for heating an image formed on a recording material while interposing and conveying the recording material at a nip portion, the image heating device comprising:

a tubular film;

a restricting member that faces an edge surface of the film at an end portion of the film in a longitudinal direction of the film and that restricts a lateral shift of the film in the longitudinal direction by receiving the edge surface of the film when the film laterally shifts in the longitudinal direction;

a roller that is in contact with an outer surface of the film and that forms the nip portion between the roller and the film;

a frame that holds the restricting member and the roller and that has a groove in which the restricting member and the roller are inserted; and a pressurizing spring that pressurizes the restricting member and the roller so as to form the nip portion, wherein the restricting member includes a grooved portion for inserting the restricting member in the groove of the frame, and a plurality of protrusions formed on the grooved portion, and wherein, when a pressure under which the image is heated is applied to the restricting member and the roller by the pressurizing spring, some of the plurality of protrusions are in contact with the frame, the others of the plurality of protrusions are not in contact with the frame, and a height of the some of the plurality of protrusions in a direction toward the frame is more than a height of the others of the plurality of protrusions.

2. The image heating device according to claim 1, further comprising a heater in contact with an inner surface of the film.

3. The image heating device according to claim 2, wherein the nip portion is formed between the heater and the roller through the film.

4. An image heating device for heating an image formed on a recording material while interposing and conveying the recording material at a nip portion, the image heating device comprising:

a tubular film;

a restricting member that faces an edge surface of the film at an end portion of the film in a longitudinal direction of the film and that restricts a lateral shift of the film in the longitudinal direction by receiving the edge surface of the film when the film laterally shifts in the longitudinal direction;

a roller that is in contact with an outer surface of the film and that forms the nip portion between the roller and the film;

a frame that holds the restricting member and the roller and that has a groove in which the restricting member and the roller are inserted; and a pressurizing spring that pressurizes the restricting member and the roller so as to form the nip portion, wherein the restricting member includes a grooved portion for inserting the restricting member in the groove of the frame, and a plurality of protrusions formed on the grooved portion, and wherein some of the plurality of protrusions approach the frame during pressurization by the pressurizing spring, the others of the plurality of protrusions leave from the frame during the pressurization by the pressurizing spring, and a height of the some of the plurality of protrusions in a direction toward the frame is more than a height of the others of the plurality of protrusions.

5. The image heating device according to claim 4, further comprising a heater in contact with an inner surface of the film.

6. The image heating device according to claim 5, wherein the nip portion is formed between the heater and the roller through the film.

7. An image heating device for heating an image formed on a recording material while interposing and conveying the recording material at a nip portion, the image heating device comprising:

a tubular film;

a restricting member that faces an edge surface of the film at an end portion of the film in a longitudinal direction of the film and that restricts a lateral shift of the film in the longitudinal direction by receiving the edge surface of the film when the film laterally shifts in the longitudinal direction;

a roller that is in contact with an outer surface of the film and that forms the nip portion between the roller and the film;

a frame that holds the restricting member and the roller and that has a groove in which the restricting member and the roller are inserted; and a pressurizing spring that pressurizes the restricting member and the roller so as to form the nip portion, wherein the restricting member includes a grooved portion for inserting the restricting member in the groove of the frame, and a plurality of protrusions formed on the grooved portion, and wherein, when a pressure under which the image is heated is applied to the restricting member and the roller by the pressurizing spring, portions of the frame are in contact with some of the plurality of protrusions and the portion of the frame protrude toward the some of the plurality of protrusions more than the other portion of the frame.

8. The image heating device according to claim 7 further comprising a heater in contact with an inner surface of the film.

9. The image heating device according to claim 8, wherein the nip portion is formed between the heater and the roller through the film.

10. An image heating device for heating an image formed on a recording material while interposing and conveying the recording material at a nip portion, the image heating device comprising:

a tubular film;

a restricting member that faces an edge surface of the film at an end portion of the film in a longitudinal direction of the film and that has a restricting surface that receives the edge surface of the film when the film laterally shifts in the longitudinal direction;

a roller that is in contact with an outer surface of the film and that forms the nip portion between the roller and the film;

a frame that holds the restricting member and the roller and that has a groove in which the restricting member and the roller are inserted; and a pressurizing spring that pressurizes the restricting member and the roller so as to form the nip portion, wherein the restricting member includes a grooved portion for inserting the restricting member in the groove of the frame, and wherein, when a pressure under which the image is heated is applied to the restricting member and the roller by the pressurizing spring, the grooved portion of the restricting member inclines with respect to the frame, and the restricting surface of the restricting member is substantially parallel to the frame.

11. The image heating device according to claim 10, further comprising a heater in contact with an inner surface of the film.

12. The image heating device according to claim 11, wherein the nip portion is formed between the heater and the roller through the film.

13. An image heating device for heating an image formed on a recording material while interposing and conveying the recording material at a nip portion, the image heating device comprising:

a tubular film;

a restricting member that faces an edge surface of the film at an end portion of the film in a longitudinal direction of the film and that restricts a lateral shift of the film in the longitudinal direction by receiving the edge surface of the film when the film laterally shifts in the longitudinal direction;

a roller that is in contact with an outer surface of the film and that forms the nip portion between the roller and the film;

a frame that holds the restricting member and the roller and that has a groove in which the restricting member and the roller are inserted; and a pressurizing spring that pressurizes the restricting member and the roller so as to form the nip portion, wherein the restricting member includes a film-restricting surface that receives the edge surface of the film when the film laterally shifts in the longitudinal direction, a pressure receiving portion that receives the pressure by the pressurizing spring, a grooved portion for inserting the restricting member in the groove of the frame, and a plurality of protrusions formed on the grooved portion, wherein, the film-restricting surface is located on a first side of the frame and the pressure receiving portion is located on a second side of the frame opposite to the first side of the frame in a case where the restricting member inserted in the groove of the frame is seen in the conveying direction of the recording material at the nip portion, and wherein, when a pressure under which the image is heated is applied to the restricting member and the roller by the pressurizing spring, a height of one protrusion, which is one of the plurality of protrusions located on the first side of the frame and in contact with the frame, in a direction toward the frame is greater than a height of another protrusion, which is another one of the plurality of protrusions located on the first side of the frame and downstream of the one of the plurality of protrusions in a pressurizing direction by the pressurizing spring, in the direction toward the frame.

14. The image heating device according to claim 13, wherein, when a pressure under which the image is heated is applied to the restricting member and the roller by the pressurizing spring, a height of one protrusion, which is one of the plurality of protrusions located on the second side of the frame and in contact with the frame, in the direction toward the frame is greater than a height of another protrusion, which is another one of the plurality of protrusions located on the second side of the frame and upstream of the one of the plurality of protrusions in the pressurizing direction by the pressurizing spring, in the direction toward the frame.

15. The image heating device according to claim 14, wherein the height of the one of the plurality of protrusions located on the first side and the height of the one of the plurality of protrusions located on the second side are the same.

16. The image heating device according to claim 15, wherein the height of the another protrusion located on the first side and the height of the another protrusion located on the second side are the same.

17. The image heating device according to claim 13, further comprising a heater in contact with an inner surface of the film.

18. The image heating device according to claim 17, wherein the nip portion is formed between the heater and the roller through the film.

19. An image heating device for heating an image formed on a recording material while interposing and conveying the recording material at a nip portion, the image heating device comprising:

a tubular film;

a restricting member that faces an edge surface of the film at an end portion of the film in a longitudinal direction of the film and that restricts a lateral shift of the film in the longitudinal direction by receiving the edge surface of the film when the film laterally shifts in the longitudinal direction;

a roller that is in contact with an outer surface of the film and that forms the nip portion between the roller and the film;

a frame that holds the restricting member and the roller and that has a groove in which the restricting member and the roller are inserted; and a pressurizing spring that pressurizes the restricting member and the roller so as to form the nip portion, wherein the restricting member includes a film-restricting surface that receives the edge surface of the film when the film laterally shifts in the longitudinal direction, a pressure receiving portion that receives the pressure by the pressurizing spring, a grooved portion for inserting the restricting member in the groove of the frame, and a plurality of protrusions formed on the grooved portion, wherein, the film-restricting surface is located on a first side of the frame and the pressure receiving portion is located on a second side of the frame opposite to the first side of the frame in a case where the restricting member inserted in the groove of the frame is seen in the conveying direction of the recording material at the nip portion, and wherein, when a pressure under which the image is heated is applied to the restricting member and the roller by the pressurizing spring, a height of one protrusion, which is one of the plurality of protrusions located on the second side of the frame and in contact with the frame, in a direction toward the frame is greater than a height of another protrusion, which is one of the plurality of protrusions located on the second side of the frame and upstream of the one of the plurality of protrusions in a pressurizing direction by the pressurizing spring, in the direction toward the frame.

20. The image heating device according to claim 19, further comprising a heater in contact with an inner surface of the film.

* * * * *